US005119349A

United States Patent [19]

Muto et al.

[11] Patent Number: 5,119,349

[45] Date of Patent: Jun. 2, 1992

[54] DISPLAY DEVICE BY MEANS OF A HAND

[75] Inventors: Takeo Muto; Masahiro Sase; Kato Yoshiaki, all of Tokyo, Japan

[73] Assignee: Citizen Watch Co., Ltd., Tokyo, Japan

[21] Appl. No.: 392,949

[22] PCT Filed: Dec. 23, 1988

[86] PCT No.: PCT/JP88/01318

§ 371 Date: Jul. 26, 1989

§ 102(e) Date: Jul. 26, 1989

[87] PCT Pub. No.: WO89/06387

PCT Pub. Date: Jul. 13, 1989

[30] Foreign Application Priority Data

Dec. 25, 1987 [JP] Japan ..... 62-326757

[51] Int. Cl.[5] ..... G04F 5/00

[52] U.S. Cl. ..... 368/157; 368/281; 368/89; 368/107

[58] Field of Search ..... 368/107-113, 368/281, 89, 157, 223-239

[56] References Cited

U.S. PATENT DOCUMENTS

| | | | |
|---|---|---|---|
| 498,209 | 5/1893 | Duncan | 368/232 |
| 1,083,917 | 1/1914 | Bryce | 368/232 |
| 1,199,730 | 9/1916 | Borresen | 368/107 |
| 1,350,131 | 8/1920 | Anderson | 368/171 |
| 1,465,045 | 8/1923 | Kern | 368/232 |
| 3,421,310 | 1/1969 | Bennet et al. | 368/107 |
| 3,461,665 | 8/1969 | Cielaszyk | 368/107 |
| 3,516,244 | 6/1970 | Papa, Jr. | 368/280 |
| 4,109,458 | 8/1978 | Suzuki et al. | 368/232 |

FOREIGN PATENT DOCUMENTS

| | | |
|---|---|---|
| 57-52880 | 3/1982 | Japan . |
| 274288 | 11/1987 | Japan . |
| 298090 | 5/1988 | Japan . |

*Primary Examiner*—Bernard Roskoski
*Attorney, Agent, or Firm*—Koda and Androlia

[57] ABSTRACT

A device for displaying information by means of a hand which is driven by a stepping motor rotatable in both forward and backward directions and which moves within a limited range, in which the stepping motor receives a driving signal enough to move and scan the hand in one direction in the whole range of the limited region for facilitating the attachment of the hand, and depending on the object to be measured, overtravel inhibiting circuit means are added to prevent any misdisplay.

12 Claims, 9 Drawing Sheets

DISPLAY DEVICE BY MEANS OF A HAND

TECHNICAL FIELD

This invention relates to a device for displaying the information processed by a digital circuit, that is, the information about time or other physical quantities, or any other information by use of a hand which is driven by a stepping motor. More particularly, this invention relates to a device provided with means for attaching the hand correctly to an output shaft of its driving mechanism so that in the event that the display region of the hand is defined, for example, as in the shape of a sector, and that accordingly the movable range of the hand or the driving mechanism is mechanically limited, correct display can be provided within that display region.

BACKGROUND

From the past, a moving-coil meter such as a circuit tester has been known as a device for displaying an electrical quantity by means of a hand which rotates within a sector-shaped region having a predetermined angle. Such an analog display system has gained much favor, since in comparison with a digital display system (numerical display), the analog display system has the merit that it is easy to read and allows the immediate and intuitive understanding of the magnitude of a displayed quantity. However, the moving-coil meter does not include a digital converting circuit for data but converts sustainedly the electrical quantity into rotary power of the hand. Thus, the meter consumes energy continuously, and hardly can it be incorporated in a miniatuarized instrument, for example, of a watch size, because of the restriction of the capacitance of the miniatuarized battery which is the incorporated power source.

On the other hand, as another example, there is a meter in which a physical quantity is converted into one or more driving signals in number in proporation to the physical quantity, then, the stepping motor is driven by the signals, next, rotary speed of the output shaft of the stepping motor is reduced by the gear train, and finally, the physical quantity is displayed by means of the hand attached to the shaft of one of the gears of the gear train. For driving the stepping motor, power may be instantaneously supplied only when reading is changed, and the physical quantity can be sampled at an arbitrary time interval and maintained within the digital circuit. Therefore, this meter is very advantageous from the viewpoint of power consumption. Also, some stepping motors have been extremely miniatuarized and their high power efficiency has been pursued. The most popular product in the meters of this type is a quartz oscillation type electronic watch, which displays the time as a physical quantity. Among the meters, there is a proposal for displaying a physical quantity other than time, using this hand display function (Japanese published unexamined utility model application No. 61-28019). However, in this prior art, since it is assumed that the hand is rotated without limit, a circular display region is required.

As further prior art, there is a proposal for displaying time information within an angular sector-shaped region by means of a hand which is driven by a stepping motor (Japanese published examined utility model application No. 63-17030). In this case, when time is full of the display range, the hand reaches the end of the display region, and as time further elapses, the hand has to be returned to the opposite end of the display region with a rapid motion. A driving signal for the stepping motor for doing this return action is generated by an electronic circuit which performs a logical action. Thus, once the hand is attached in the correct relation with respect to the electronically controlled hand driving mechanism, it is expected that the relation in phase between the electronic logical operation and the hand position cannot be displaced insofar the time display or the like which makes a regular repetition change is concerned. However, an effective method or system has not been provided for attaching the hand in a proper position (direction) in agreement with the logic state of the electronic circuit, especially when the movable range of the hand is mechanically restricted. Whatever physical quantities are to be measured, this synchronization is necessary and in order to mass-produce a device having a sector-shaped display function by use of a stepping motor, some effective synchronizing means are essential.

Furthermore, in the event that as in temperature and pressure, the physical quantity to be measured and displayed does not always fall within a predetermined display region and that the movable range of the hand is limited, a further problem will be posed. The reasons are as follows:

In the meter using a method of converting a physical quantity into the number of driving signals in proportion to the physical quantity and feeding the hand by means of the stepping motor, the absolute value of a physical quantity will not be given to the motor as stepping signals therefor (the method of returning the hand to the reference position every measuring sampling is possible but not preferable because it is inferior in traceability to the variations of measured values), and when physical quantities vary every moment, the difference between the last measured value and the new measured value, that is, incremental value, is given to the motor as the signals for the stepping motor so that the stepping motor can be fed in the forward or reverse direction by the difference. In this connection, one example of the methods for moving the stepping motor forward or backward at will is disclosed in U.S. Pat. No. 4,112,671.

Accordingly, suppose that the hand and its interlocking member hit a stop or obstacle and stop outside the measuring angle range, and then that an additional signal corresponding to the amount of the overtravel is applied. In that case, the stepping motor will be forced to stop as it is, even if the driving current flows. Furthermore, if at the next sampling, the physical quantity returns to the usual measurable range, a signal will be applied to the stepping motor for driving the hand additionally by the amount of the difference between the last overtraveled measured value and the present measured value. But as mentioned above, owing to the function of the stop, the hand is not located in the position where it should have been located and starts moving from the position where the stop has been hit. As a result, the next stopped position does not correspond to the correct measured value but points to a wrong position.

Also, in order to use a known structure generally used for analog quartz watches as a stepping motor (comprising a coil; a rotor having a permanent disc magnet magnetized so as to produce two poles across the diameter of the magnet; and a pair of yokes sandwiching the rotor at both sides and magnetically connected to the ends of the magnetic core of the coil, respectively), it is necessary to give bipolar driving pulses in which the polarity is reversed each step. Unless it is driven with the correct polarity, the hand will not move and a miscount will be caused. If the number of driving signals equal to the amount of the aforementioned overtravel for idling the stepping motor after the hand is blocked by the stop and rests, is an even number of steps, the hand will follow immediately by the first return pulse and performs return action, but if the number of driving signals equal to the amount of overtravel is an odd number, it is often that the hand will not follow by the first return pulse, thereby constituting a factor of miscounting which causes the misplacement of the hand.

DISCLOSURE OF THE INVENTION

The object of the invention is, by solving the above-mentioned problems, to provide a device driven by a stepping motor for display by means of a hand within a limited region;

(1) in general, comprising means for attaching the hand correctly and effectively in the event that the movable range of the hand is limited, and (2) further comprising means for preventing the misplacement of the hand which may happen, depending on the type of the physical quantity to be measured. That is to say, in respect of the above item (1), the invention relates to a hand display device provided with circuit means for, when desired, driving the stepping motor continuously in one direction by the number of steps at least corresponding to the movable range of the hand (circuit means is also available which further permits the stepping motor to step back by the small number after driving it in one direction) for facilitating the attachment of the hand. In respect of the above item (2), the invention relates to a hand display device further comprising circuit means for inhibiting the generation of the stepping motor driving signal corresponding to the physical quantity beyond the display range.

BRIEF DESCRIPTION OF THE DRAWINGS

FIG. 5 (*b*) is its sectional view;

BEST MODE FOR CARRYING OUT THE INVENTION

Now, the present invention will be described in detail with reference to the respective embodiments shown in the accompanying drawings;

First embodiment

Figure 1:
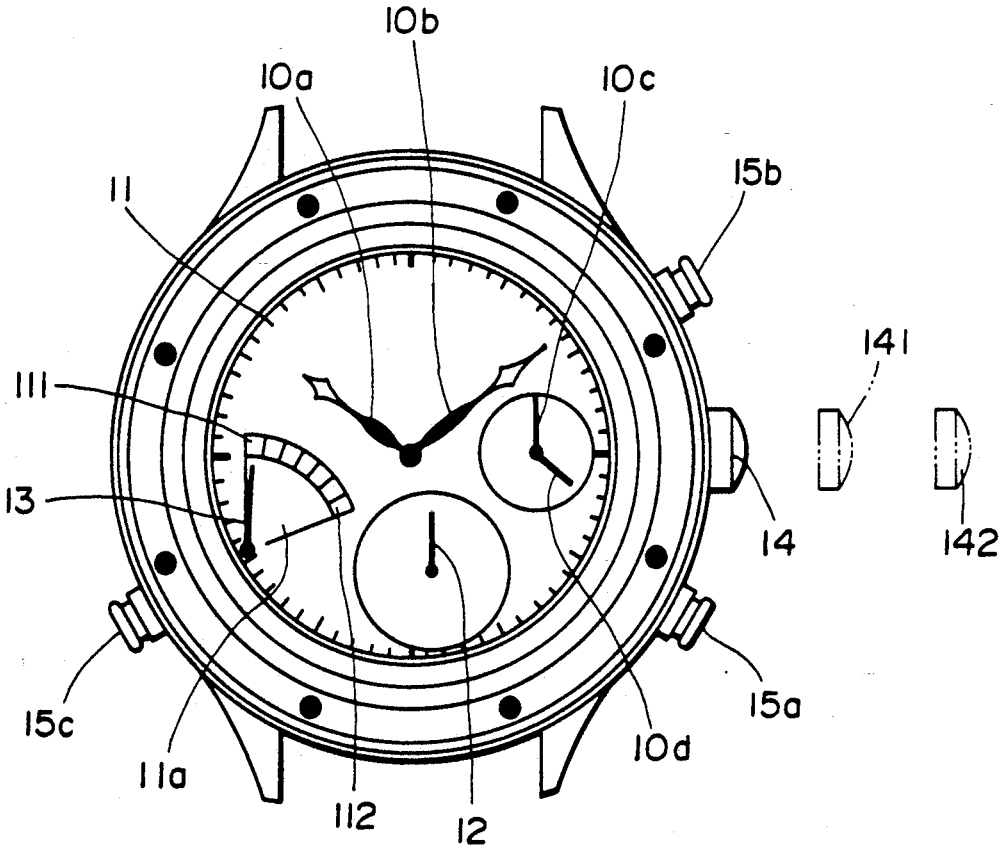
FIG. 1 is a plan view of the appearance of an electronic watch with a hand display type calendar of a first embodiment according to the invention.

This embodiment is a watch having an appearance shown in FIG. 1 and has a display portion by means of a hand which moves in a sector-shaped range as a part of the entire display. The physical quantity displayed in the hand display sector-shaped portion is time information, and it is the calendar day information as one piece of the time information.

DESCRIPTION OF THE MECHANICAL PARTS OF THE FIRST EMBODIMENT

Referring to FIG. 1, there are shown an hour hand 10*a*, a minute hand 10*b* and a second hand 10*c* for indicating ordinary time and a 24-hour display hand 10*d* which makes one revolution in 24 hours. They step per second (1 Hz) as in an ordinary electronic three-hand display watch and display the present time. 11 denotes a dial on which besides time display divisions and date display divisions, a day display portion 11*a* has divisions for seven days from Sunday 111 to Saturday 112 in a clockwise direction from the upper left side in the shape of a sector.

12 denotes a date hand for displaying a calendar date, which steps per day and makes one revolution in 31 days.

13 denotes a day hand for displaying a calendar day, which steps once per day from Sunday 111 to Saturday 112 and reaches the position of Saturday 111 in six steps.

From Saturday 112 to Sunday 111, the hand returns instantaneously the above-mentioned six steps by a rapid feed of 32 Hz (0.2 sec) counterclockwise. The day hand 13 rotationally reciprocates once a week in the sector shape. The date hand 12 and the day hand 13 are systematized so as to step by the day respectively, under electrical control by a switching signal applied every 24-hours from a calendar change-over switch 227 (switch S4) which will be discussed later.

14 denotes a crown which is an external control member. By pulling out the crown (stem) to a second position 142 and rotating it clockwise or counterclockwise, the hour hand 10*a*, the minute hand 10*b* and the 24-hour display hand 10*d* are corrected, as in ordinary electronic analog watches. Also when the crown 14 is pulled out to the second position 142, a known reset switch 229 (switch S6) is turned ON, and the second hand 10*c* stops at the desired position. A first state 141 of the crown 14 provides the hand position correction mode for correcting the hand positions by electrically moving the date hand 12 and the day hand 13. In this first state 141, a hand position correction switch 228 (switch S5) turns ON.

15*a* denotes a push button (button PB1) for electrically correcting the hand position of the day hand 13. By controlling the button PB1, a day hand correction switch 221 (switch S1) turns ON. Like this button PB1 15*a*, 15*b* denotes a hand position correction push button (button PB2) for the date hand 12 for turning ON a day correction switch 222 (switch S2). When the button PB2 15*b* is depressed for a short time (quick operation), the date hand 12 advances one step, and when the button PB2 15*b* is depressed and held for a longer time, e.g.

2 seconds (continuous operation), the date hand 12 is driven clockwise by a rapid feed of 32 Hz.

15*c* denotes a mode setting button (button PB3) for attaching the day hand 13 under the second state 142 of the crown 14. By pressing the button PB3, a day hand set switch 223 (switch S3) turns ON.

Figure 2:
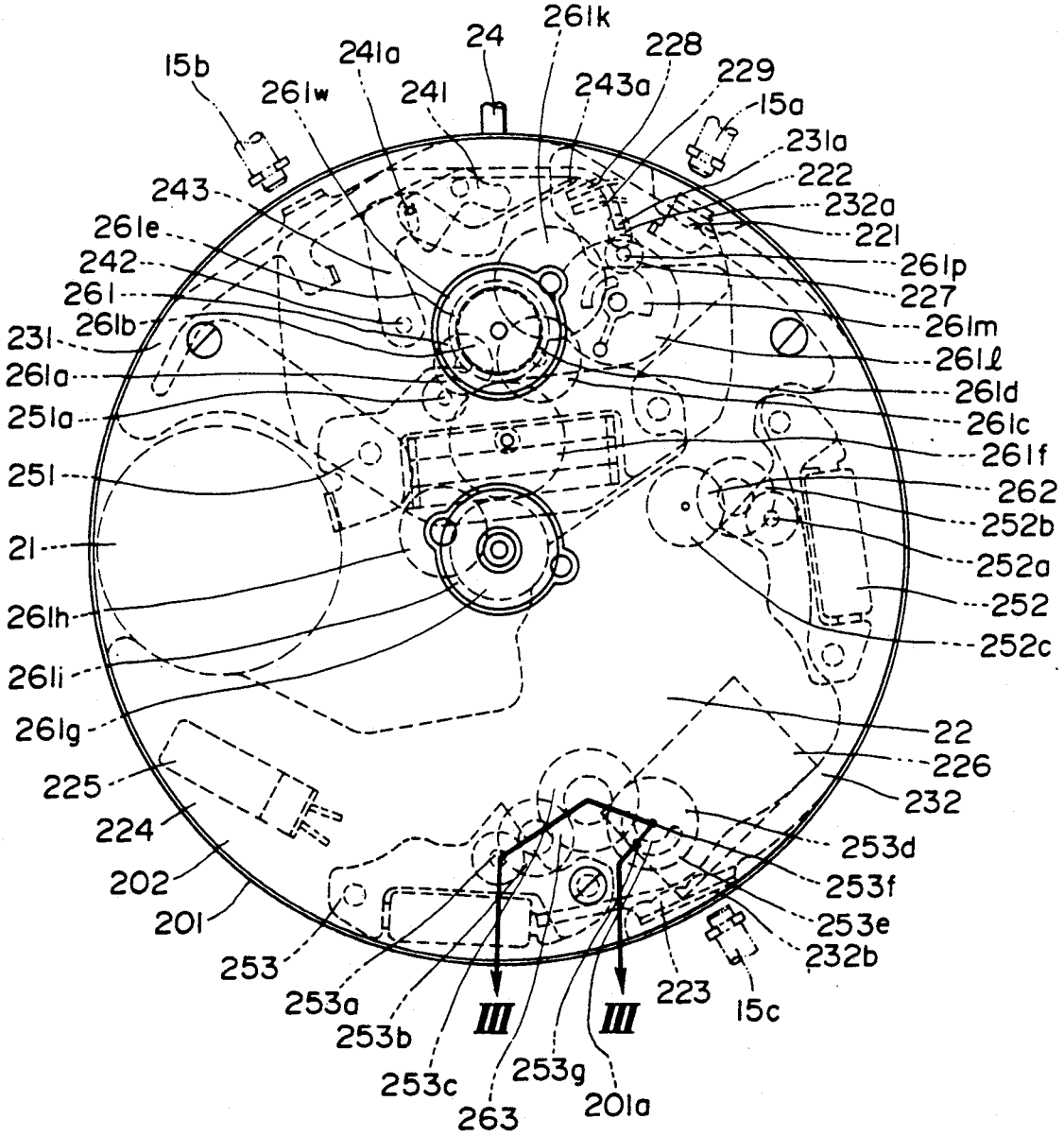
FIG. 2 is a plan view of the module (movement) of the same embodiment when viewed from the dial side.
Figure 3:
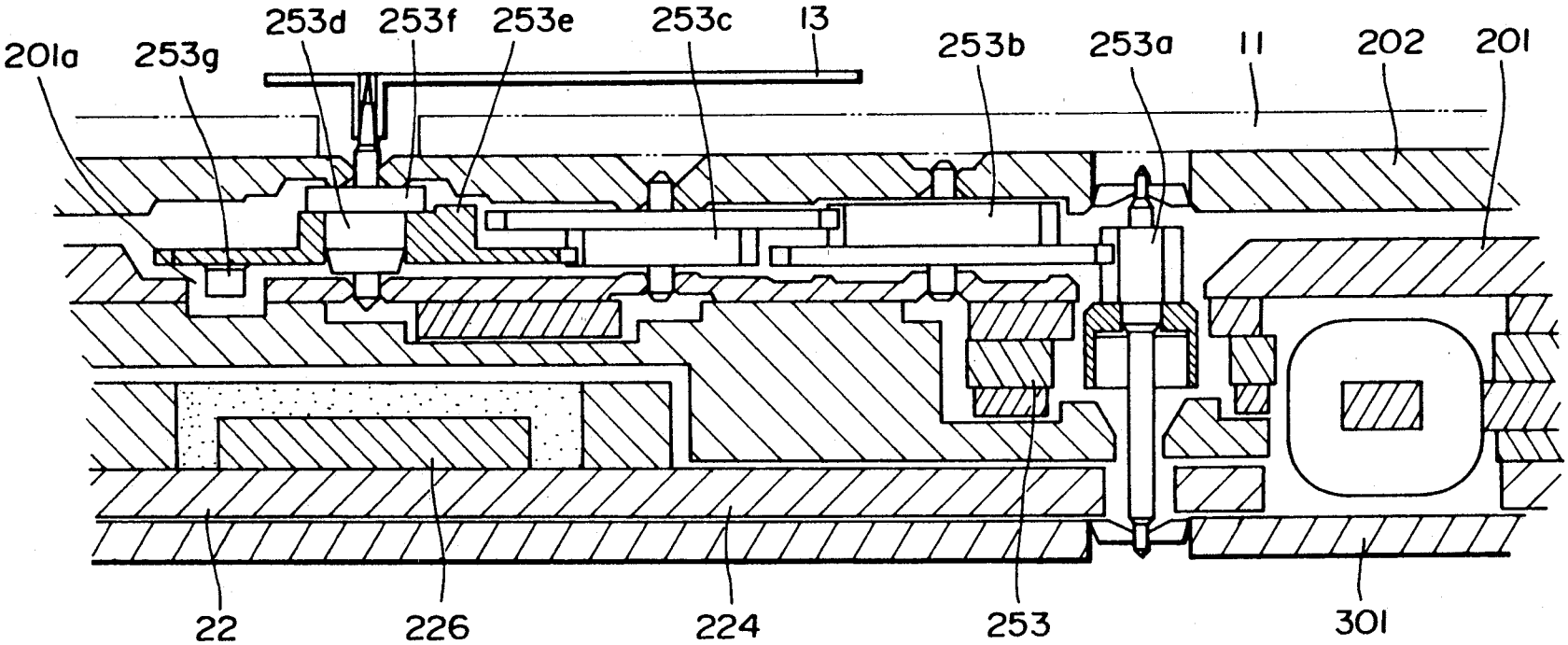
FIG. 3 is a sectional view taken along the line III—III of FIG. 2.

In FIGS. 2 and 3, 201 denotes a plate; 202 denotes a lower bridge; 301 denotes a gear train bridge; and 21 denotes a battery which is the power source.

22 denotes a circuit block in which a quartz oscillator 225, IC chip 226 and so on are mounted on a circuit board 224 where conductive patterns for electrically connecting electronic elements and side patterns which constitute the contacts on fixed sides of the switch S1 221, switch S2 222, switch S3 223 and so on are wired.

231 and 232 denote switch springs (I) and (II) constructing the mechanism of the aforementioned switches S1, S2 and S3, 221, 222 and 223, and by depressing the buttons PB1, PB2 and PB3, 15*a*, 15*b* and 15*c*, respectively, movable contacts 232*a*, 231*a* and 232*b* of the switch springs (I) and (II) depressingly come into contact with side pattern portions arranged at the side of the circuit board 224 or arranged in a through-hole and perform switching operations.

The mechanism of switches S5 and S6, 228 and 229 performs a switching operation by pulling out the crown 14. The mechanism meshes with a setting lever pin 241*a* integral with a setting lever 241 which is a constructing member of a known external control switch-over mechanism 24. A top end 243*a* of a reset lever 243 which operates around a rotating shaft 242 slides compressively on the circuit board 224 and comes into contact with patterns of switches S5 and S6, 228 and 229 wired on the circuit board 224, thereby performing the switching operation.

251 denotes a stepping motor A (motor A) which is an electromechanical transducer for driving a normal time display train 261. 252 and 253 denote stepping motors B and C (motor B and motor C) for driving a date train 262 and a day train 263, respectively.

The normal time display train 261 is rotatively powered by a rotor A 251*a* constructing the motor A 251 and drives a fifth wheel 261*a* a fourth wheel 261B (bearing the second hand 10*c*), a third wheel 261*c*, a center wheel 261*d*, a second intermediate wheel (II) 261*e*, a second intermediate wheel (I) 261*f*, a second wheel 261*g* (bearing the minute hand 10*b*), a minute wheel (I) 261*h* and an hour wheel 261*i* (bearing the hour hand 10*a*).

The aforementioned switch S4 227 is constructed so that a revolution is transmitted from the second intermediate wheel (II) 261*e* which is forcedly fitted onto the center wheel 261*d*, through an intermediate switch wheel 261*k*, to a switch wheel 261*l* which makes a revolution in 24 hours and so that a switch spring 261*m*, which interlocks with the switch wheel 261*l* and rotates, comes depressingly into contact with a switch terminal 261*p* which conducts to switch patterns wired on the circuit board 224, thus performing a switching operation. Also, the 24-hour display hand 10*d* is provided on a second hour wheel 261*n* which is coaxially located with the center wheel 261*d* through the intermediate switch wheel 261*k*.

The date train 262 is constructed to transmit a revolution from a rotor B 252*a* which composes the motor B 252, via an intermediate date wheel 252*b*, to a date wheel 252*c* which bears the date hand 12.

The day train 263 is constructed to transmit a revolution from a rotor C 253*a* which composes the motor C 253, via an intermediate day wheel (II) 253*b* and an intermediate day wheel (I) 253*c*, to a day wheel 253*d* which bears the day hand 13.

The day wheel 253*d* comprises the two parts of a day wheel gear 253*e* and a day wheel staff 253*f* made of synthetic resin, and the day wheel gear 253*e* has a stopping pin 253*g* at the wheel gear surface on the side of the plate 201. The stopping pin 253*g* constitutes a stop for restricting the revolution of the day wheel 253*d*, together with an arc slot 201*a* provided in the plate 201.

Figure 4A:
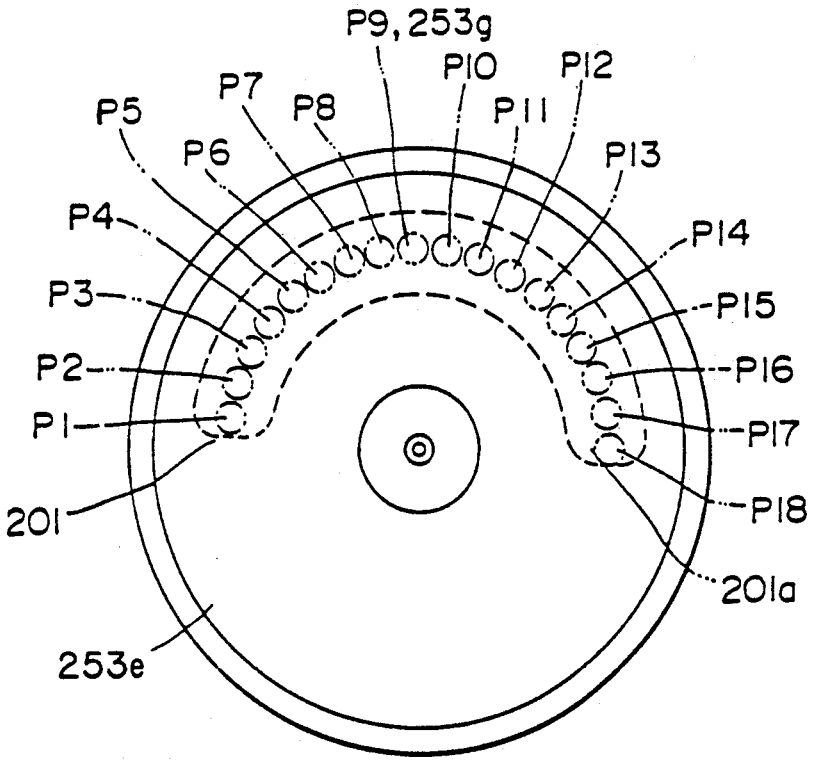
FIG. 4 (*a*) and (*b*) are operational plan views of the sector-shaped day display portion of the same embodiment.
Figure 4B:
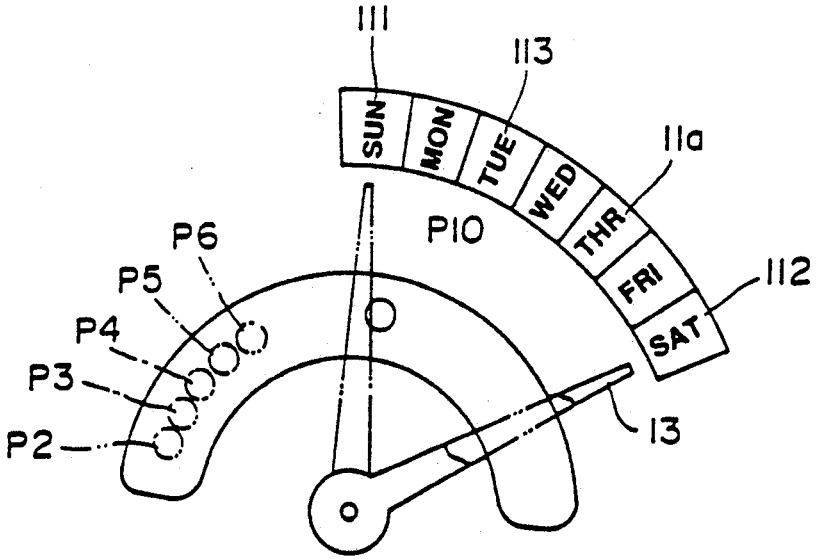

Next, referring to FIG. 4, the rotary operation and day display of the day wheel 253*d* viewed from the dial side will be described. The operation of the circuit block such as the switch control circuit and hand control circuit will be discussed later.

After assembling the module parts, in the complete module state incorporating the battery 21 which is the power source, the circuit block 22 is all reset under electrical control, and driving signals to the respective motors 251, 252, 253 are in their off state. Then the crown 14 is pulled out to the second position 142 and rotated to turn ON the switch S6 229, and then the button PB3 15*c* is depressed once to turn ON the switch S3 223 and to release all resets of the circuit block 22, thus establishing the operation starting state. Then, the circuit block 22 produces reverse driving signals for eighteen steps to drive the rotor C 253*a* by a rapid feed of 32 Hz, and through the day wheel train 263, the day wheel 253*d* revolves counterclockwise. The stopping slot 201*a* in the plate 201 is shaped into such a form that when the number of driving revolutions of the rotor C 253*a* is converted into the number of drive steps of the stopping pin 253*g* of the day wheel 253*d*, the rotor C 253*a* can be driven for a maximum of seventeen steps. Therefore, the stopping pin 253*g* reaches a position P1 at the left side of a stopping wall 201*b* of the plate 201 from any position (P1 to P18) within the stopping slot 201*a*. Furthermore, the circuit block 22 produces forward driving signals for nine steps to drive the rotor C 253*a* by a rapid feed of 32 Hz, and by these driving signals, the day wheel 253*d* is revolved clockwise and the stopping pin 253*g* stops at the position P10.

The above-mentioned operation of the day wheel 253*d* is performed continuously within one second after all resets are released.

Next, keeping the stopped condition of the day wheel 253*d*, the dial 11 and the respective hands 10*a*, 10*b*, 10*c*, 10*d* and 12 are mounted and the day hand 13 is fitted in alignment with the position of Saturday 112. Thus, the relative position between the stopping pin 253*g* and the day hand 13 is established for the first time.

Next, the hand control circuit of the circuit block 22 and the initial setting method of the day hand 13 will be explained.

With the crown 14 kept in the second state 142, the button PB1 15*a* is depressed once. Then, the circuit block produces the motor driving signals for eight steps to drive the rotor C 253*a* counterclockwise by a rapid feed of 32 Hz, and the stopping pin 253*g* moves from P10 to P2 with the revolution of the day wheel 253*d*.

In the second or more depressing operation of the button PB1 15*a*, the day wheel 253*d* rotates clockwise step by step every depressing operation to a maximum of four steps (position of Tuesday 113), and in the next one depressing operation, the day wheel 253*d* returns four steps counterclockwise by a rapid feed of 32 Hz. Thus the driving in the sector shape is repeated by controlling the button PB1 15*a* so that the day hand 13 is aligned with the position of Sunday 111 which is the initial setting position.

With this respect, in order to release the initial setting mode, the switch S6 229 is turned OFF, that is, the crown 14 is returned to any position other than the second position. The initial setting position of the day hand 13 and the hand control circuit coincide, and the day hand 13 is driven under electrical control.

Next, the operation of the day wheel 253*d* will be explained for setting the date hand 12 and the day hand 13 to the present calendar.

With the crown 14 in the first state 141 to turn ON the switch S5, the button PB2 15*b* is depressed for a short or long time (quick or continuous) to set the date hand 12. Every time the button PB1 15*a* is depressed, the day hand 13 is advanced day by day clockwise, and in six depressing operations, it is moved from Sunday 111 to Saturday 112, and in the seventh depressing operation, the day hand 13 returns six steps counterclockwise by a rapid feed of 32 Hz. Thus by repeating the driving operation in the sector shape, the day hand 13 is set to the present day.

In this connection, the regions P11 to P18 are provided outside the working range of the stopping pin 253*g* of the day wheel 253*d* so as to prevent trouble in the event that the user daily wears the watch carelessly with the initial setting position of the day hand 13 set in a wrong position such as Tuesday 113, and then excessive disturbance such as shock causes the day hand 13 to be displaced (action for making a revolution from the day wheel 253*d* to the rotor C 253*a*).

Figure 5A:
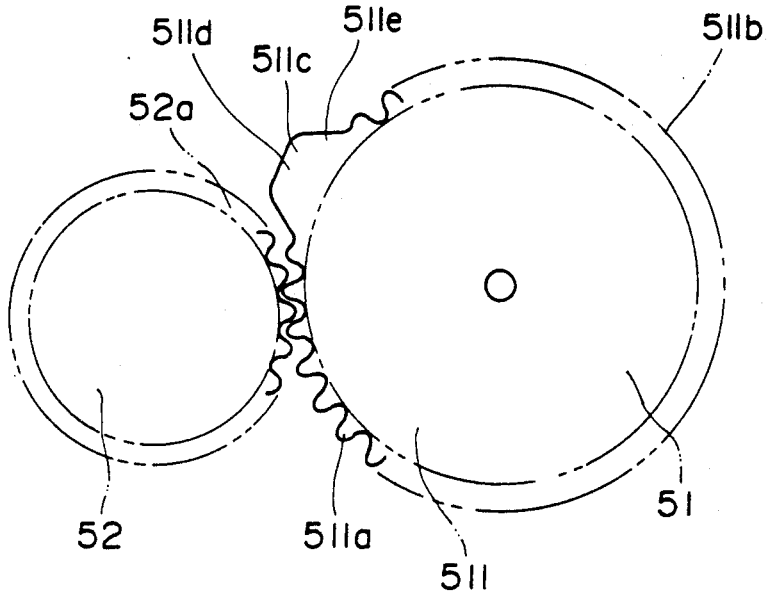
FIG. 5 (*a*) is a partial plan view illustrating a variation of the stop mechanism of the sector-shaped day display portion of the same embodiment.
Figure 5B:
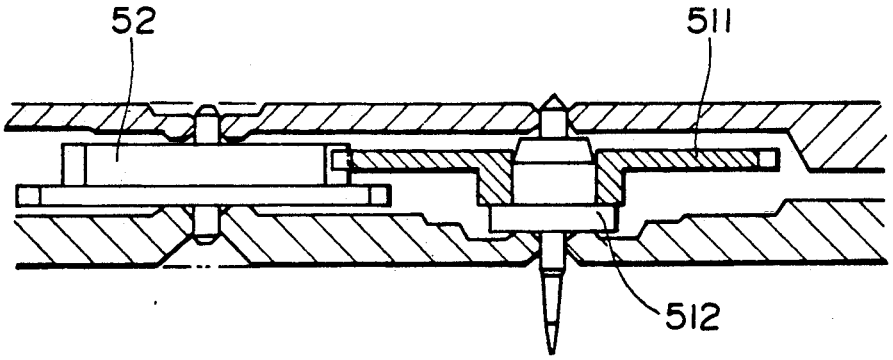

FIG. 5 shows a variation of the stopping mechanism of the day wheel, in which (a) is a plan view of the main parts and (b) is a sectional view of the main parts.

A day wheel 51 comprises a day wheel gear 511 and a day wheel staff 512 made of synthetic resin. The day wheel gear 511 is formed integrally with a projection 511*c* in which part of gear teeth 511 is projected in a flat position from the outer diameter of addendum 511*b*. When the day wheel 51 revolves with the revolution of an intermediate day wheel 52, an end 511*d* of the projection 511*c* interferes with the addendum 52*a* of the intermediate day wheel 52, and the revolution is restricted.

In addition, when the intermediate day wheel 52 is driven in reverse, an end 511*e* opposite to the end 511*d* of the projection 511*c* of the day wheel gear 511 interferes with the addendum 52*a* of the intermediate day wheel 52 to restrict the revolution of the day wheel 51.

DESCRIPTION OF CIRCUITS OF THE FIRST EMBODIMENT

Figure 6:
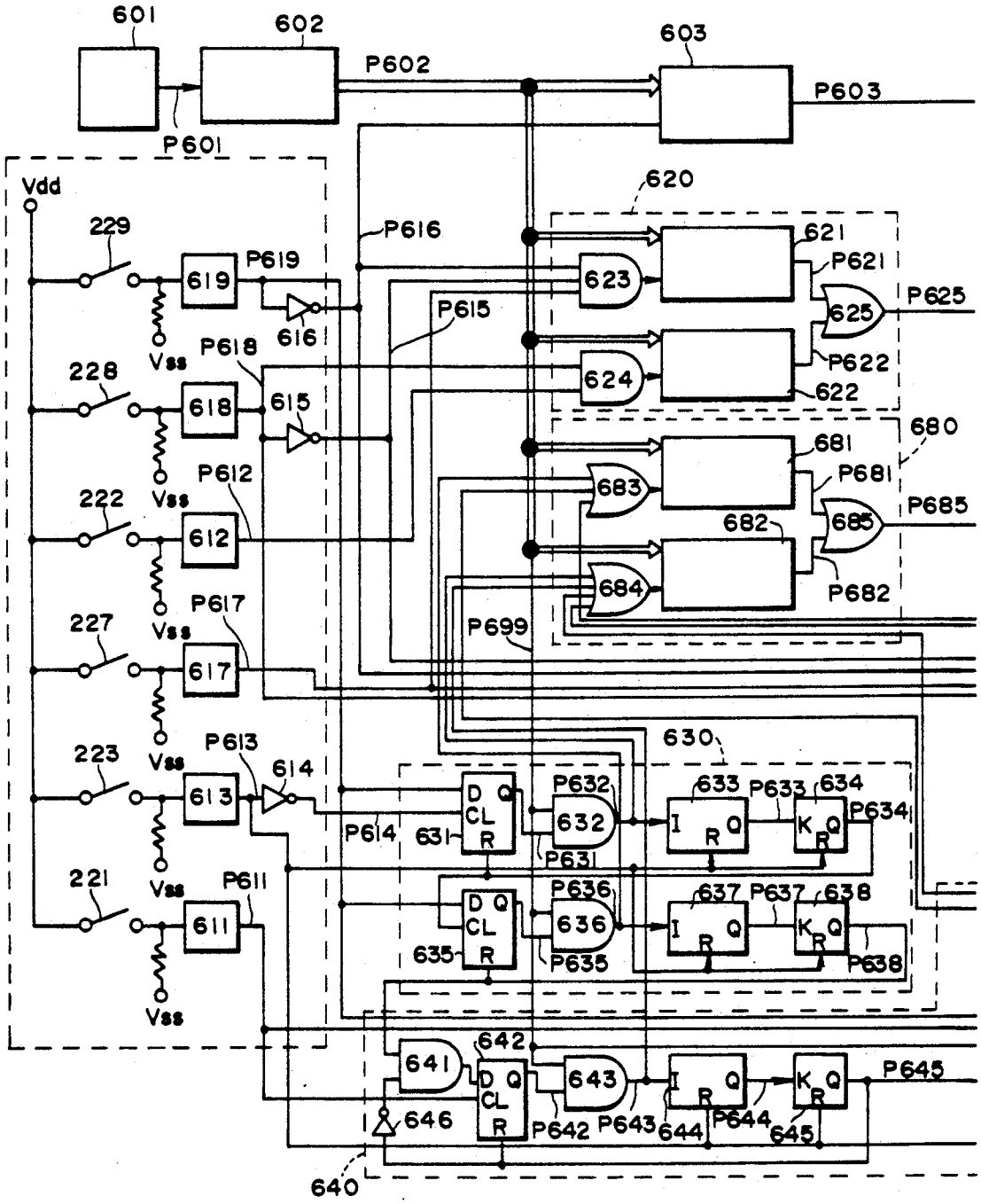
FIG. 6 (*a*) and (*b*) is a block diagram of the electromechanical circuit of the same embodiment.
Figure 6:
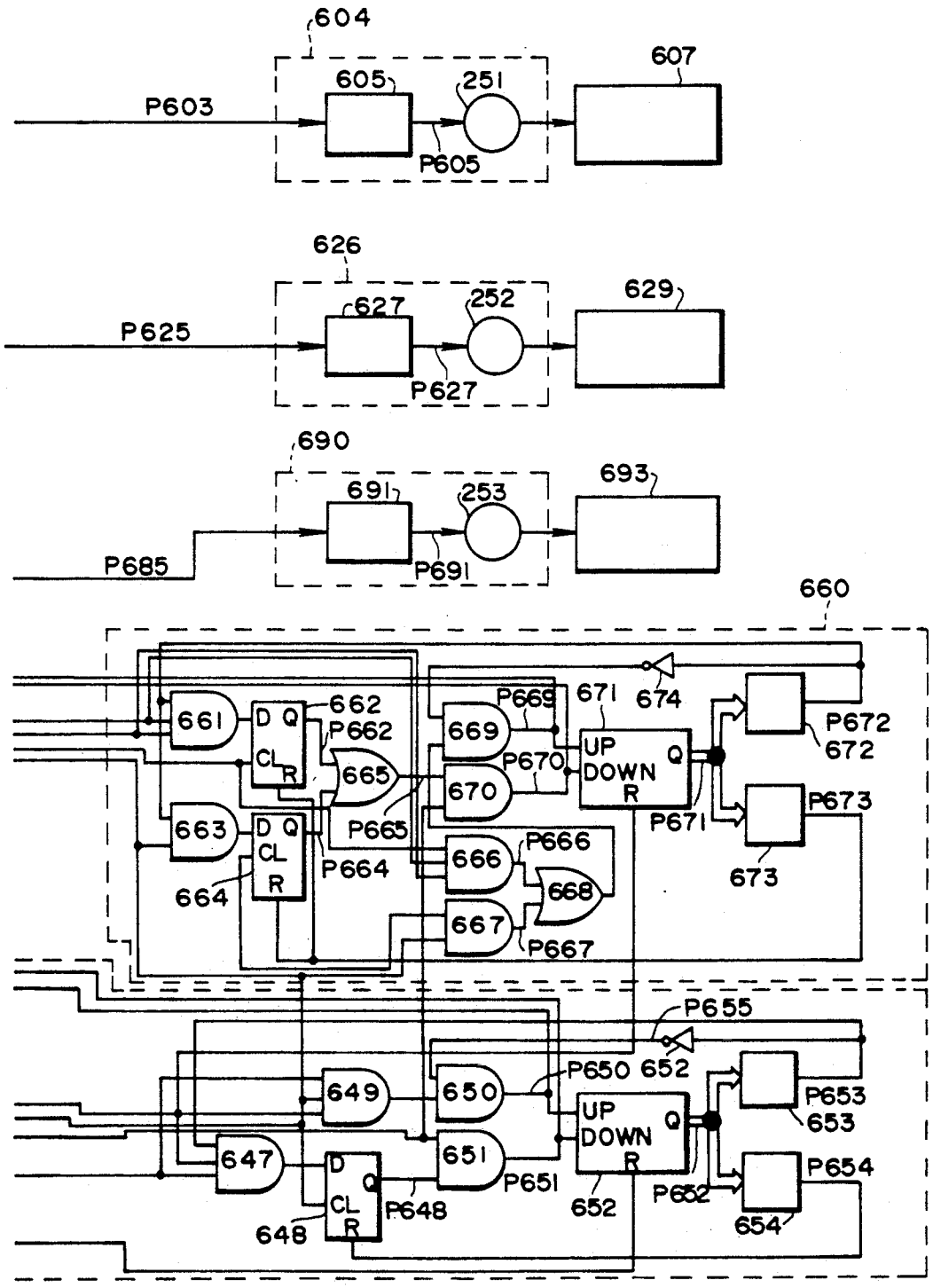

With reference to the block diagram of FIG. 6 (divided into FIG. 6 (*a*) and FIG. 6 (*b*)), the construction and electromechanical operation of the circuit will be described.

601 denotes a time reference source which generates a time reference signal P601 (32,768 Hz).

602 denotes an oscillating circuit which comprises a frequency divider of a plurality of stages whose input receives the time reference signals P601 of the time reference source 601 and whose output supplies a signal group of divided signals P602 and a 32-Hz signal P699 which is a 32-Hz divided signal.

610 is a switching circuit, and 221, 222, 223, 227, 228 and 229 are a total of six switches of switch S1, switch S2, switch S3, switch S4, switch S5 and switch S6 discussed with reference to FIG. 1. The respective switches produce a day hand correction signal P611, date hand correction signal P612, initial setting signal P613, calendar feed signal P617, calendar mode signal P618 and reset signal P619, via their respective chattering preventing circuits 611, 612, 613, 617, 618 and 619.

Also, the switching circuit 610 has inverters (INVS) 614, 615 and 616. The INV 616 receives the reset signal P619 and produces an inverted reset signal P616. The INV 615 receives the calendar mode signal P618 and produces an inverted calendar mode signal P615. The INV 614 receives the initial set signal P613 and produces an inverted initial set signal P614.

A time signal generating circuit 603 receives the predetermined divided signal P602 of the dividing circuit 602 and the inverted reset signal P616 of the switching circuit 610 and produces a one-second period time signal P603 for time driving when the inverted reset signal P616 is "HIGH", that is, the crown 14 of FIG. 1 is in the rest or the first state (141 of FIG. 1).

604 denotes time hand driving means which comprise a time hand driving circuit 605 and the motor A 251 (see FIG. 2). The time hand driving circuit 605 receives the time signal P603 and produces a time hand driving signal P605 from its output terminal. The time hand driving signal P605 is applied to the motor A 251 to operate the gear train and hand for time 607 interlocking with the motor A 251. That is to say, by driving the second hand 10*c* (see FIG. 1), the minute hand 10*b*, the hour hand 10*a*, and the 24-hour display hand 10*d* which mechanically interlock with the second hand 10*c* are set and provide the time display.

620 denotes date display means which comprise a date feed signal generating circuit 621, an electromagnetic date hand correction circuit 622, a three-input AND gate 623 (AND 623), a two-input AND gate 624 (AND 624) and a two-input OR gate 625 (OR 625).

The AND 623 receives the inverted reset signal P616 of the switching circuit at the first input terminal; the inverted calendar mode signal P615 of the switching circuit 610 at the second input terminal; and the calendar feed signal P617 of the switching circuit 610 at the third terminal.

The date feed signal generating circuit 621 receives the predetermined divided signal P602 of the frequency dividing circuit 602 and the output signal of the AND 623. Whenever the inverted reset signal P616 and the inverted calendar mode signal P615 are "HIGH", that is, whenever the crown 14 of FIG. 1 is in the rest position, by the timing of the calendar feed signal P617, the date feed signal generating circuit 621 produces a date feed signal P621 for date feed driving at a period of 24 hours in this mode.

The AND 624 receives the calendar mode signal P618 of the switching circuit 610 at one of the input terminals and the date hand correction signal P612 of the switching circuit 610 at the other of the input terminals.

The electromagnetic date hand correction circuit 622 receives the predetermined divided signal P602 and the output signal of the AND 624. When the calendar mode signal P618 is "HIGH", that is, the crown 14 of FIG. 1 is pulled out to the first position 141, this circuit 622 produces a date hand correction signal P622 for electromagnetic correction under control of the button PB2 15*b* used for electromagnetic date hand correction. position 141.

The OR 625 receives the date feed signal P621 at one of the input terminals and the date hand correction signal P622 at the other of the input terminals, and produces a date display signal P625 from the output terminal.

626 denotes date hand driving means which comprise a date hand driving circuit 627 and the motor B 252.

The date hand driving circuit 627 receives the date display signal P625 of the date display means 620 and produces a date hand driving signal P627 from its output terminal. The date hand driving signal P627 is applied to the motor B 252 (see FIG. 2) to operate the gear train and hand for date 629. That is to say, the date hand 12 is driven and displays the date.

630 denotes a day train initial control circuit for initializing the day hand train for sector-shaped display and comprises a D type flip-flop circuits (D-FFS) 631 and 635; two-input AND gates (ANDS) 632 and 636; a base-18 (octdenary) counter 633; a base-9 (nevenary) counter 637; an 18-pulse occurrence detecting circuit 634 and a 9-pulse occurrence detecting circuit 638.

The D-FF 631 receives the reset signal P619 of the switching circuit 610 at the input terminal D; the inverted initial set signal P614 of the switching circuit 610 at the input terminal CL; and an 18-pulse occurrence detecting signal P634 of the 18-pulse occurrence detecting circuit 634 at the input terminal R. When the crown 14 of FIG. 1 is in the second state 142, that is, the switch S6 229 is ON and the button PB3 15*c* is controlled, that is, the operation for initializing the day hand train is performed, the D-FF 631 produces, from the output terminal Q, a day train reverse enable signal P631 for rapidly feeding the day hand train first in the reverse direction (the D-FF 631 is reset by the 18-pulse occurrence detecting signal P634 which will be discussed later).

The AND 632 receives the 32-Hz signal P699 of the frequency dividing circuit 602 at one of the input terminals and the day train reverse enable signal P631 at the other of the input terminals. When the day train reverse enable signal P631 is "HIGH", a total of eighteen 32-Hz signals P699 are produced from the output terminal of the AND 632 as day initial reverse control signal P632.

The base-18 counter 633 receives the day initial reverse control signals P632 at the input terminal I and the initial set signal P613 of the switching circuit 610 at the input terminal R. When the base-18 counter 633 counts a total of eighteen initial reverse control signals P632 after once reset under control for initializing the aforementioned day hand train, a base-18 carry signal P633 is produced from its output terminal Q.

The 18-pulse occurrence detecting circuit 634 receives the base-18 carry signal P633 at the input terminal K and the initial set signal P613 of the switching circuit 610 at the input terminal R. When the base-18 carry signal P633 is applied, the 18-pulse occurrence detecting circuit 634 produces the 18-pulse occurrence detecting signal P634 from its output terminal Q.

The D-FF 635 receives the reset signal P619 of the switching circuit 610 at the input terminal D; the 18-pulse occurrence detecting signal P634 of the 18-pulse occurrence detecting circuit 634 at the input terminal CL; and a 9-pulse occurrence detecting signal P638 of the 9-pulse occurrence detecting circuit 638 which will be discussed later at the output terminal R. In brief, by controlling the day hand train for initialization as mentioned above, the day hand train is operated 18 steps in the reverse direction, and the 18-pulse occurrence detecting signal P634 is produced. Next, a day train forward enable signal P635 is produced for rapidly feeding the day hand train in the forward direction. and then the 9-pulse occurrence detecting signal P638 (discussed later) is produced from Q, thus resetting the D-FF 635.

The AND 636 receives the 32-Hz signal P699 of the frequency dividing circuit 602 at one of the input terminals and the day train reverse enable signal P635 at the other of the input terminals. When the day train forward enable signal P635 is "HIGH", a total of nine 32-Hz signals P699 are produced from the output terminal of the AND 636 as day initial forward control signals P636.

The base-9 counter 637 receives the day initial forward control signal P636 at the output terminal I and the initial set signal P613 of the switching circuit 610 at the input terminal R. By controlling the day hand train for initialization as mentioned above, the base-9 counter 638 is once reset, the base-9 counter 637 counts a total of nine day initial forward control signals P636 and then produces a base-9 carry signal P637 from its output terminal Q.

The 9-pulse occurrence detecting circuit 638 receives the initial set signal P637 at the input terminal K and the initial set signal P613 of the switching circuit 610 at the input terminal R. When the base-9 carry signal P637 is applied, the 9-pulse occurrence detecting circuit 638 produces a 9-pulse occurrence detecting signal P638 from its output terminal Q.

640 denotes a day hand initializing control circuit for controlling the action to set (initialize) the day hand 13 to the zero position, and comprises D-type flip-flop circuits 642 and 648 (D-FFS), two-input AND gates 641, 643, 650, 651 (ANDS), three-input AND gates 647 and 649 (ANDS), inverters 646 and 655 (INVS), a base-8 (octonary) counter 644, an 8-pulse occurrence detecting circuit 645, an up-and-down counter 652 (UD counter), a 4-detecting circuit 653 and a 0-detecting circuit 654.

The AND 641 receives the 9-pulse occurrence detecting signal P638 of the 9-pulse occurrence detecting circuit 638 at one of the input terminals and an output signal of the INV 646 (discussed later) at the other of the input terminals. After the day hand train has been controlled for initialization as mentioned above, the output signal of the INV 646 is maintained "HIGH". Therefore, after the day hand train is initialized, that is, the day hand train is operated 18 steps in the reverse direction and then 9 steps in the forward direction, the 9-pulse occurrence detecting signal P638 is produced, thus causing the output signal of the AND 641 to go "HIGH".

The D-FF 642 receives the output signal of the AND 641 at the input terminal D; the day hand correction signal P611 of the switching circuit 610 at the input terminal CL; and an 8-pulse occurrence detecting signal P645 of the 8-pulse occurrence detecting circuit 645 which will be discussed later at the input terminal R. After the day hand train is initialized as mentioned above, by depressing the button PB1 15*a* with the crown of FIG. 1 pulled out to the second position, the D-FF 642 produces, from the output terminal Q, the day hand reverse motion enable signal P642 for reversing the day hand 13 from position "Saturday" in which the day hand 13 has been attached to position "Sunday" which is the initializing position. The D-FF 642 is reset when the 8-pulse detecting signal P645 (discussed later) is produced.

The AND 643 receives the 32-Hz signal P699 of the frequency dividing circuit 602 at one of the input terminals and the day hand reverse motion enable signal P642 at the other of the input terminals. When the day hand reverse motion enable signal P642 is "HIGH", the 32-Hz signal P699 is produced from the output terminal of the AND 643 as a day hand reverse motion control signal P643.

The base-8 counter 644 receives the day hand reverse motion control signal P643 at the input terminal I and the initial set signal P613 of the switching circuit 610 at the input terminal R. By controlling the aforementioned day hand for initialization, the base-8 counter 644 is once reset and starts counting day hand reverse motion control signals P643. When eight signals are counted, the base-8 counter 644 produces a base-8 carry signal P644 from its output Q.

The 8-pulse occurrence detecting circuit 645 receives the base-8 carry signal P644 at the input terminal K and the initial set signal P613 of the switching circuit 610 at the input terminal R, and produces an 8-pulse occurrence detecting signal P645 from the output terminal Q.

The AND 649 receives the 8-pulse occurrence detecting signal P645 at the first input terminal; the day hand correction signal P611 of the switching circuit 610 at the second input terminal; and the reset signal P619 of the switching circuit 610 at the third input terminal.

The AND 650 receives an inverted 4-detecting signal P655 of the INV 655 which will be discussed later at one of the input terminals and an output signal of the AND 649 at the other input terminal.

That is to say, when the day hand train is controlled counterclockwise, toward the initializing position and then the button PB1 15*a* is depressed with the crown kept in the second position, as an output signal of the AND 649, the day hand correction signal P611 passes through the AND 649, and when the inverted 4-detecting signal P655 is "HIGH", the AND 650 produces a day hand initial forward control signal P650 for initializing the day hand 13 by use of the day hand correction signal P611.

The AND 647 receives a 4-detecting signal P653 of the 4-detecting circuit 653 which will be discussed later at the first input terminal; the reset signal P619 of the switching circuit 610 at the second terminal; and the 8-pulse occurrence detecting signal P645 at the third terminal.

When the day hand train is moved counterclockwise, toward the initializing position as mentioned above and then the 4-detecting signal P653 of the 4-detecting circuit 653 (discussed later) is "HIGH" with the crown 14 in the second position state, the output signal of the AND 647 is "HIGH".

The D-FF 648 receives the output signal of the AND 647 at the input terminal D; the day hand correcting signal P611 of the switching circuit 610 at the input terminal CL; and a 0-detecting signal P654 of the 0-detecting circuit 654 which will be discussed later at the input terminal R. When the AND 647 is in the "HIGH" state and the button PB1 is depressed with the crown 14 kept in the second position, the D-FF 648 produces, from the output terminal Q, a day hand initial reverse enable signal P648 for initializing the day hand 13. The D-FF 648 is reset by the 0-detecting signal P654 which will be discussed later.

The AND 651 receives the 32-Hz signal P699 of the frequency dividing circuit 602 at one of the input terminals and the day hand reverse enable signal P648 at the other of the input terminals. When the hand reverse enable signal P648 is "HIGH", the AND 651 produces a day hand initial reverse control signal P651 from the output terminal by use of the 32-Hz signal P699.

The UD counter 652 is a base-5 (quinary) up-and-down counter whose count value corresponds to the position of the day hand 13 at the time of initialization. The UD counter 652 counts up in response to the signal applied to an input terminal UP and counts down in response to the signal applied to an input terminal DOWN. The count value is reset to "0" by the "HIGH" signal applied to an input terminal R. The UD counter 652 receives the day hand initial forward control signal P650 at the input terminal UP; the day hand initial reverse control signal P651 at the input terminal DOWN; and the initial set signal P613 of the switching circuit 610 at the input terminal R, and produces a day initializing count signal P652 which is a group of signals of the count value corresponding to the position of the day hand 13 at the time of initialization.

The 4-detecting circuit 653 receives the day initializing count signal P652. When the UD counter 652 counts up and finds that the count value reaches "4", the 4-detecting circuit 653 produces the 4-detecting signal P653, which is always produced while the count value is "4".

The 0-detecting circuit 654 receives the day initializing count signal P652. When the UD counter 652 counts down and finds that the count value reaches "0", the 0-detecting circuit 654 produces the 0-detecting signal P654, which is always produced while the count value is "0".

The INV 655 receives the 4-detecting reverse signal P653 and produces the inverted 4-detecting signal P655.

660 denotes a day hand normal control circuit for feeding the day hand 13 once a day under the normal use condition and setting the day hand 13 to the present "day" under the calendar set condition and comprises D type flip-flop circuits 662 and 664 (D-FFS), two-input AND gates 663, 667, 669 and 670 (ANDS), three-input AND gates 661 and 666 (ANDS), an inverter 674 (INV), two-input OR gates 665 and 668 (ORS), and up-and-down counter 671 (UD counter), a 6-detecting circuit 672 and a 0-detecting circuit 673.

The AND 661 receives a 6-detecting signal P672 of the 6-detecting circuit 672 which will be discussed later at the first input terminal; the inverted calendar mode signal P615 of the switching circuit 610 at the second input terminal; and the inverted reset signal P616 of the switching circuit 610 at the third input terminal. When, with the crown 14 in the normal use state of the rest position, the 6-detecting signal P672 of the 6-detecting circuit 672 (discussed later) is "HIGH", that is, when the day hand 13 is in position "Saturday", the output signal of the AND 661 is "HIGH".

The D-FF 662 receives the output signal of the AND 661 at the input terminal D; the calendar feed signal P617 of the switching circuit 610 at the input terminal CL; and a 0-detecting signal P673 of the 0-detecting circuit 673 which will be discussed later at the input terminal R.

When the AND 661 is in the "HIGH" state and the terminal CL is switched from "LOW" to "HIGH", that is, the calendar feed signal P616 is produced, the D-FF 662 produces a normal reverse enable signal P662 for reversing the day hand 13 from "Saturday" to "Sunday" under the normal use condition.

The AND 663 receives the 6-detecting signal P672 of the 6-detecting circuit 672 at one of the input terminals and the calendar mode signal P618 of the switching circuit 610 at the other of the input terminals. When in the calendar set condition with the crown 17 pulled out to the first position, the 6-detecting signal P672 of the 6-detecting circuit 672 (discussed later) is "HIGH", that is, when the day hand 13 is in position "Saturday", the output signal of the AND 663 is "HIGH".

The D-FF 664 receives the output signal of the AND 663 at the input terminal D; the day hand correction signal P611 of the switching circuit 610 at the input terminal CL; and the 0-detecting signal P673 of the 0-detecting circuit 673 which will be discussed later at the input terminal R.

When the AND 663 is in the "HIGH" state and the terminal CL is switched from "LOW" to "HIGH", that is, the crown 14 of FIG. 1 is in the first position and the button PB1 15*a* is depressed, the D-FF 664 produces, from the output terminal Q, a day hand set reverse enable signal P664 for reversing the day hand 13 from "Saturday" to "Sunday" under the calendar set condition.

The OR 665 receives the day hand normal reverse enable signal P662 at one of the input terminals and the day hand set reverse enable signal P664 at the other input terminal, and produces a day hand normal reverse enable signal P665 which is the logical sum of the two enable signals.

The AND 670 receives the day hand normal reverse enable signal P665 at one of the input terminals and the 32-Hz signal P699 of the frequency dividing circuit 602 at the other of the input terminals. When the day hand normal reverse enable signal P665 is "HIGH", the AND 670 produces a day hand normal reverse control signal P670 from its output Q by use of the 32-Hz signal P699.

The AND 666 receives the calendar feed signal P617 of the switching circuit 610 at the first input terminal. At its second and third input terminals, the AND 666 receives signals in the same manner as in the AND 661. When the crown 14 is in the normal use condition of the rest position and the calendar feed signal P616 is produced, the AND 666 produces a day hand normal forward control signal P666 from its output terminal by use of the calendar feed signal P616.

The AND 667 receives the day hand correction signal P611 of the switching circuit 610 at one of the input terminals and the calendar mode signal P618 of the switching circuit 610 at the other of the input terminals. When the crown 14 of FIG. 1 is in the first position, i.e. the calendar set condition, and the button PB1 15*a* is depressed, the AND 667 produces a day hand set forward control signal P667 by use of the day hand correction signal P611.

The OR 668 receives the day hand normal forward control signal P666 at one of the input terminals and the day hand set forward control signal P667 at the other of the input terminals, and produces the logical sum of the two control signals from the output terminal.

The AND 669 receives an inverted 6-detecting signal P674 of the INV 674 which will be discussed later at one of the input terminals and the output signal of the OR 668 at the other of the input terminals. When the inverted 6-detecting signal P674 is "HIGH", that is, the day hand 13 is located in any other position than "Sunday", and the day hand normal forward control signal P666 or the day hand set forward control signal P667 is produced, the AND 669 produces the day hand normal forward control signal P669 from its output terminal.

The UD counter 671 is a base-7 (septenary) up-and-down counter whose count value corresponds to the position of the day hand 13 (from "Sunday" to "Saturday"), counts up in response to the signal applied to an input terminal UP, and counts down in response to the signal applied to an input terminal DOWN, and the count value is reset to "0" in response to the "HIGH" signal applied to an input terminal R.

The UD counter 671 receives the day hand normal forward control signal P669 at the input terminal UP; the day hand normal reverse control signal P670 at the input terminal DOWN; and the reset signal P619 of the switching circuit 610 at the input terminal R. The UD counter produces, from the output terminal Q, a day hand position count signal P671 which is a group of count values for the day hand position.

The 6-detecting circuit 672 receives the day hand position count signal P671. When the UD counter 671 counts up and finds that the count value reaches "6", the 6-detecting circuit 672 produces the 6-detecting signal P672 which is always produced while the count value is "6".

The 0-detecting circuit 673 receives the day hand position count signal P671. When the UD counter 671 counts down and finds that the count value reaches "0", the 0-detecting circuit 673 produces the 0-detecting signal P673 which is always produced when the count value is "0".

The INV 674 receives the 6-detecting signal P672 and produces the inverted 6-detecting signal P674.

680 denotes day signal generating means comprising a day forward signal generating circuit 681, a day reverse signal generating circuit 682, a two-input OR gate 685 (OR), a three-input OR gate 683 (OR) and a four-input OR gate 684 (OR).

The OR 683 receives the day initial forward control signal P636 of the day train initial control circuit 630 at the first input terminal; the day hand initial forward control signal P650 of the day hand initializing control circuit 640 at the second input terminal; and the day hand normal forward control signal P669 of the day hand normal control circuit 660 at the third input terminal. A signal of their logical sum is produced from the output terminal of the OR 683.

The day forward signal generating circuit 681 receives the predetermined frequency dividing signal P602 of the frequency dividing circuit 602 and the output signal of the OR 683. By the timing of the output signal of the OR 683, a day forward signal P681 is produced for driving the day train and hand 693 (discussed later) in the forward direction.

The OR 684 receives the day initial reverse control signal P632 of the day train initial control circuit 630 at the first input terminal; the day hand reverse motion control signal P643 of the day hand initializing control circuit 640 at the second input terminal; the day hand initial reverse control signal P651 of the day hand initializing control circuit 640 at the third input terminal; and the day hand normal reverse control signal P670 of the day hand normal control circuit 660 at the fourth terminal. A signal of the logical sum is produced from the output terminal of the OR 684.

The day reverse signal generating circuit 682 receives the predetermined frequency dividing signal P602 of the frequency dividing circuit 602 and the output signal of the OR 684. By the timing of the output signal of the OR 684, the day reverse signal generating circuit 682 transmits a 32-Hz day reverse signal P682 for driving the day train and hand 693 (discussed later) in the reverse direction.

The OR 685 receives the day forward signal P681 at one of the input terminals and the day reverse signal P682 at the other of the input terminals, and produces a day driving signal P685 which is the logical sum of these signals from its output terminal.

690 denotes day driving means comprising a day driving circuit 691 and the third motor 253. The day driving circuit 691 receives the day driving signal P685 of the day signal generating means 680 and produces a day driving signal P691 from its output terminal. The day driving signal P691 enables the day train and hand 693 interlocking with the third motor 253 to operate and display each day after the day hand 13 is attached.

As is apparent from the above description, in the initializing condition with the crown 14 in the second position, the day hand 13 is initialized to the position "Sunday" which is the rest position, and in the calendar set condition with the crown 14 in the first position, the date hand 12 and the day hand 13 are set to the present calendar. Then the device is used in the normal use condition with the crown in the rest position. However, in the case of the sector-shaped driving display like the day hand 13, it is necessary to initialize the day train and position it with respect to the day hand 13 when the day hand 13 is attached. It is the day train initial control circuit 630 to control the above. As the initializing action of the day train, the day hand train is driven in the reverse direction by 18 steps and then driven in the forward direction by 9 steps. At this time, the day hand 13 is attached to position "Saturday".

Second embodiment

Figure 7:
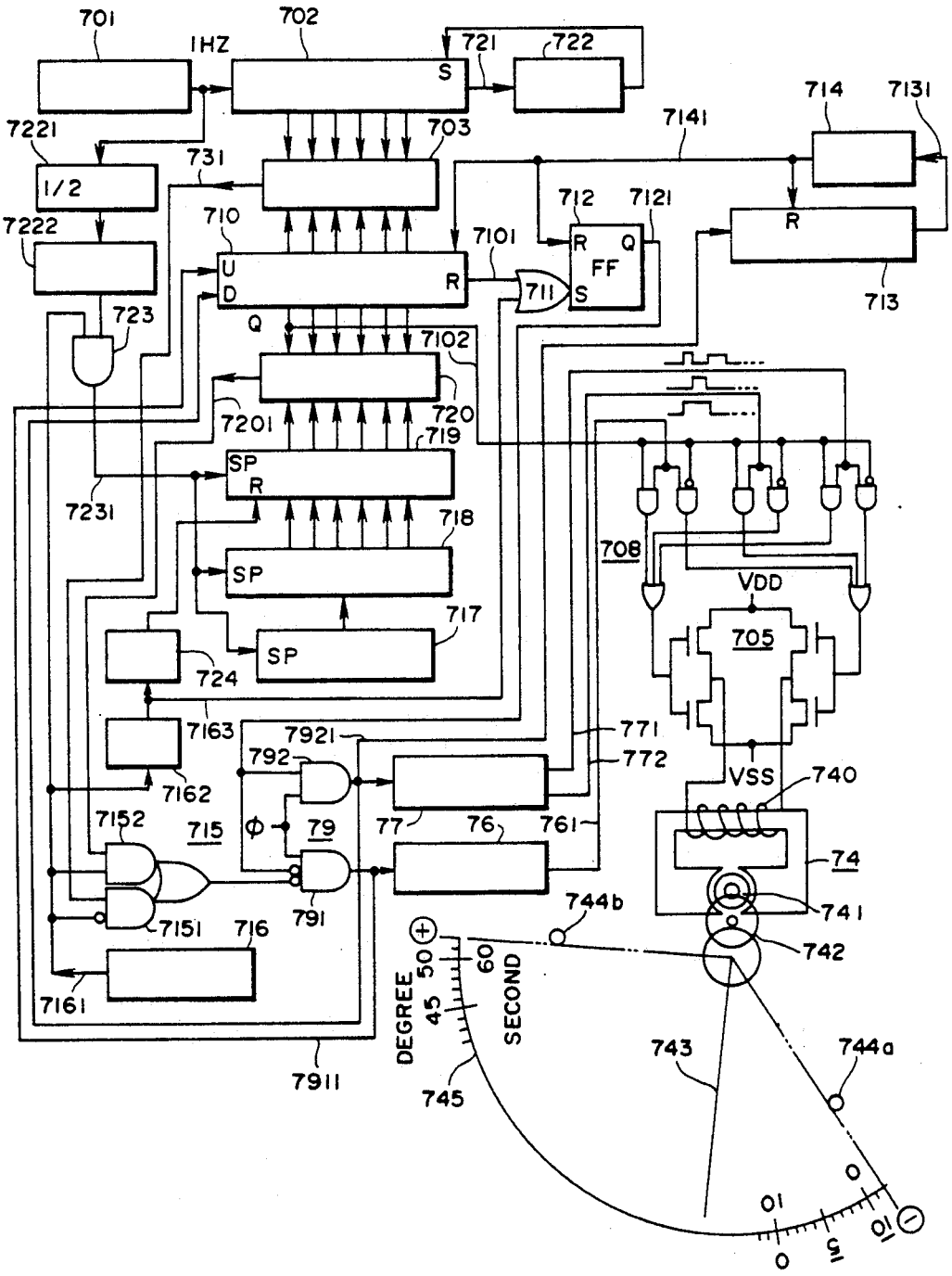
FIG. 7 is a block diagram of the electromechanical circuit of an electronic watch provided with a temperature measurement function of the second embodiment according to the invention.

This embodiment is a watch having a temperature measuring function and a timekeeping function for displaying both pieces of information at the same sector-shaped hand display portion. The illustration of the appearance is omitted, and the structure and the operation will be described with reference to the block diagrams of FIGS. 7 and 8.

In this embodiment, all the circuits perform positive logic operations.

First of all, the timekeeping and basic operations will be discussed.

701 denotes an oscillating and dividing circuit for the time display of seconds which uses a quartz oscillator as a reference oscillating source and divides its frequency to produce a 1-Hz signal (hours and minutes are displayed by use of separate stepping motors and hands which are not shown). Its output is sent to a timekeeping counter 702 (preset type base-60 (sexagesimal) counter) for counting seconds. When the counter counts a total of sixty 1-Hz signals from the preset value, a full-count output is produced on a line 721, slightly delayed by a delay circuit 722, applied to a set terminal S of the timekeeping counter 702 as a preset signal, and resets the timekeeping counter 702 to the preset value (in this case it is "2" and details will be discussed later). The logic state of each of cascade binary elements making up the timekeeping counter 702 is applied as a group to a coincidence detecting circuit 703 at its one set of comparison inputs. 74 denotes a reversible stepping motor, and for example, as disclosed in U.S. Pat. No. 4,112,671, the direction of rotation is changed by the waveform of the applied signal to a driving circuit 705.

740 is a driving coil; 741 is a rotor equipped with a permanent magnet and pinion; 742 is a reduction gear train engaging the rotor pinion; 743 is a hand; and 744*a* and 744*b* are stops, for example, pins fixed in the dial, for limiting the angle of motion of the hand 743. 745 is divisions and numerals or symbols marked on the dial. In this embodiment, the inside of the divisions is graduated in 0 to 60 seconds and the outside is graduated in −10 to 50 degrees of temperature. Furthermore, at both outsides of the significant range of divisions are two spare divisions respectively. By one step driving, the hand 743 steps each division. In addition, marks of (+) and (−) at both sides show that an indication has overshot.

"$\phi$" denotes a rapid feed signal which is obtained from an appropriate intermediate output at the frequency divider stages of the oscillating and dividing circuit 701, for example, a frequency of 64 Hz, and this is a clock signal for the purpose of driving the stepping motor into its rapid feed in the forward or reverse direction at this frequency. 76 denotes a forward motion signal generating circuit and 77 denotes a reverse motion signal generating circuit, and with respect to each step of motor driving, the former generates a unidirectional pulse for driving the rotor 741 forward simply, and the latter generates a bidirectional composite pulse group for swinging the rotor 741 once and then rotating it by one step in the reverse direction. Either driving signal is sent via a switching gate group 708 to one of two input terminals of the driving circuit 705 comprising a pair of C-MOS inverters. At the input sides of the forward and backward motion signal generating circuits, there is provided a rotation direction switching gate 79 comprising AND gates 791 and 792. Either AND gate 791 or 792 feeds signals $\phi$ to its corresponding forward motion signal generating circuit 76 or reverse motion signal generating circuit 77 as necessary and excite it. As a result, with respect to each of clock waveforms of signals $\phi$ which have passed through the rotation direction switching gate 79, a forward or backward motion signal is outputted one by one.

The forward motion signal is outputted to a line 761 and its waveform is a somewhat wide single-shot pulse of the same waveform as used for the normal watch driving (the waveform per step is shown at the upper side of the line 761). The reverse motion signal comprises a plurality of pulse waveforms to be outputted to lines 771 and 772 with a predetermined phase shift. Outputted to the line 771 are a first pulse and a third pulse (shown at the upper side of the line 771) which are supplied every step of the reverse motion. Outputted to the line 772 is a second pulse (shown at the upper side of the line 772) which is generated between both the above pulses. At the time of reversal, the function of the first pulse is to start the rotor 741 slightly in the forward direction, the function of the second pulse is to return the rotor 741 to the stable point (the rotor 741 has been displaced slightly in the forward direction from the magnetically stable point by the first pulse), and the function of the third pulse to force the rotor 741 further into the reverse direction from the stable point so as to complete one step of the reversal. The driving circuit 705 has two inputs belonging to the respective inverters, and depending on which terminal receives an input signal, the direction of the exciting current which flows in the coil 740 is switched. In either case of forward and reverse motions, the direction of current must be reversed every step. A switching signal line 7102 of the switching gate group 708 is connected to an output Q of the binary element at the first stage of a hand position counter 710, and therefore, every time the stepping motor 74 steps forward or backward by one step, the output to the driving circuit 705 is switched to the right or the left of the driving circuit 705 on the figure.

The hand position counter 710 is a base-64 up-and-down counter. Every time its up input terminal U receives the signal $\phi$ for forward motion excitement which has passed through the AND gate 791 and produced on a line 7911, an addition is made. Every time its down input terminal D receives the signal $\phi$ for reverse motion excitement which has passed through the AND gate 792 and produced on a line 7921, a subtraction is made. When a full-count is attained at the time of the forward motion, a full-count output is developed on a line 7101 and passes through an OR gate 711 to set an RS flip-flop 712. At this time, an output Q generated on a line 7121 is set to "1", acts on the rotation direction switching gate 79 and opens the AND gate 792, thereby performing the switching operation so as to output the signal $\phi$ onto the line 7921.

The signal $\phi$ for reverse motion excitation developed on the line 7921 is applied to a base-64 reverse motion counter 713. When the reverse motion counter 713 counts the reverse motion excitation signal $\phi$ 64 times, it outputs a full-count signal to a line 7131. This signal is slightly delayed by a delay circuit 714 and outputted to a line 7141 as a reset signal to reset the reverse motion counter 713, the RS flip-flop 712, and the hand position counter 710, respectively. The output Q of the RS flip-flop 712 is set to "0" level again and opens the AND gate 791. That is to say, whenever the stepping motor 74 is in the reverse motion state, it must take 64 steps in the reverse direction in order to return to the forward motion state.

In the hand position counter 710, the group of outputs Q of binary elements at the respective stages comprises the other set of comparison inputs of the coincidence detecting circuit 703. The coincidence detecting circuit 703 makes a comparison with the state of each of the stages of the timekeeping counter 702 (these stages comprise the aforementioned one set of comparison inputs of the coincidence detecting circuit 703). When the coincidence is brought about, a "1" level signal is developed on a line 731, which, in turn, passes through an AND gate 7151 within a function switching gate 715 and applies a negative input to the AND gate 791 to close it, thereby inhibiting any further provision of the forward motion excitation signal $\phi$ to the forward motion signal generating circuit 76 and the hand position counter 710. That is to say, the following action is always done; when the time to be displayed, e.g. seconds, is advanced by the timekeeping counter 702, the hand position counter 710 starts rapid forward feeding so as to restore the delay immediately, and when the counts of both counters coincide, the hand rests.

Next, as a physical quantity other than the time information, a temperature measurement will be described. 716 denotes a function switching circuit for switching the hand display function from timekeeping function to temperature display function and comprises a manual switch; a chattering preventing circuit; and a flip-flop circuit for keeping the switched function state until the manual switch is operated again even if it is released. When the manual switch is actuated, a function switching output at "1" level is produced on a line 7161 to close the AND gate 7151 and open an AND gate 7152 within the function switching gate 715. Also the function switching output is logically differentiated by a pulsing circuit 7162 and flows from a line 7163 through the OR gate 711 to set the RS flip-flop 712 whose output Q acts on the rotation direction switching gate 79 so as to make the signal $\phi$ flow only in the reverse motion signal generating circuit 77.

After all, whenever the function switching operation is performed, the motor is put in the reverse motion operation state, but this state is temporary as will be discussed later.

717 denotes a sensor circuit which outputs the measured result of a temperature as an analog electric quantity. 718 denotes an A/D converting circuit for converting this electric quantity to a digital quantity. The digital quantity is stored in a data latch circuit 719, and this digital quantity and the output of the hand position counter 710 are compared by a coincidence detecting circuit 720. In the case of non-coincidence, the state of the signal produced on a line 7201 is at a "0" level, and therefore the output of the function switching gate 715 remains the "0" level, which acts on the negative input terminal of the AND gate 791, permitting the signal $\phi$ to pass through the forward motion signal generating circuit 76. On the other hand, when the coincidence output at a "1" level is produced on the line 7201, the signal $\phi$ for forward motion excitation is blocked.

SPs in the sensor circuit 717, A/D converting circuit 718, and data latch circuit 719 stand for sampling terminals. Sampling inputs given to the SPs permit the sensor circuit 717 to make a measurement, the A/D converting circuit 718 to carry out a conversion and the data latch circuit 719 to take in data. The 1-Hz output of the oscillating and dividing circuit 701 is reduced to $\frac{1}{2}$ Hz by a $\frac{1}{2}$ frequency dividing circuit 7221 and further becomes a 2-second interval triggering pulse by a pulsing circuit 7222. This trigger pulse passes through an AND gate 723 which has opened by the function switching circuit output which has become a "1" level, then passes a line 7231, and is applied to each of the aforementioned SP terminals as a sampling signal.

The output of the pulsing circuit 7162 is applied to a timer circuit 724, and at the moment, the timer circuit 724 produces a signal which takes a "1" level during a predetermined time (2 to 3 seconds) and then returns to a "0" level. This signal is fed to a reset terminal R of the data latch circuit 719 to force it to be reset and make all comparison outputs zeros. Immediately after the function switching circuit 716 is manually operated, the data latch circuit 719 is in the reset state for two or three seconds, and, on the other hand, as discussed before, the operation of the RS flip-flop 712 permits the stepping motor 74, that is, the hand 743, to reverse by 64 steps, also the content of the hand position counter 710 to be reset to zero and the hand to return fully counterclockwise and to hit the stop 744*a* and then to halt. The substantial operation of the temperature measuring function starts after the sampling signal is produced on the line 7231. Of course, it is often that the reversal of the number of steps corresponding to the full scale for the hand 743 is brought about when the hand 743 is at any intermediate position of the divisions 745. Even at this time, since steps are taken back corresponding to all positions of the hand 743, the hand 743 always abuts against the stop 744*a* and stops. On the other hand, the hand position counter 710 is also reset, and therefore, when the reverse operation is completed, the hand 743 and the hand position counter 710 are automatically in phase at each starting point.

As will be apparent from the discussion, this embodiment provides a display device by means of a hand for displaying a physical quantity by moving the hand forward or backward by an angle of a unit per step to reciprocate the hand within a predetermined number of steps, comprising a stepping motor and a displaying mechanism; a stepping motor driving circuit; and a converting circuit for converting the physical quantity into forward or backward driving signals equal in number to the steps corresponding to the physical quantity and for sending the driving signals to the driving circuit, also including the structure of the display device by means of a hand characterized by a mechanical stop for restricting the movement of the hand so as not to exceed at least one of the ends of the predetermined range; and compensation circuit means for driving the stepping motor at any time by the number of steps corresponding to the number required to scan the predetermined angular range from end to end in the direction toward the stop or by the number of steps which exceeds the number required to scan, by a fixed number, (the compensation circuit means comprise the reverse motion counter 713, the gate 79 and such which are actuated when the function switching circuit 716 is operated or when the display reaches the maximum value). Therefore, it is effective to restore a phase shift between the hand and the hand position counter which may happen by a shock or electric noise applied to the display device. Also when the hand is attached to the hand shaft during the process of assembling the device, the above-mentioned operation is once done and then the hand is attached so as to bring it into contact with the stop 744*a*, the polarity of a starting pulse determined by the state of the binary element (reset and determined) at the first stage of the hand position counter 710 and the direction of the magnetic pole of the rotor 741 are agreed to avoid a miscount. Thus it is also effective for production. Of course, the full-scale position can be given in either direction and reciprocation is also possible.

Figure 8:
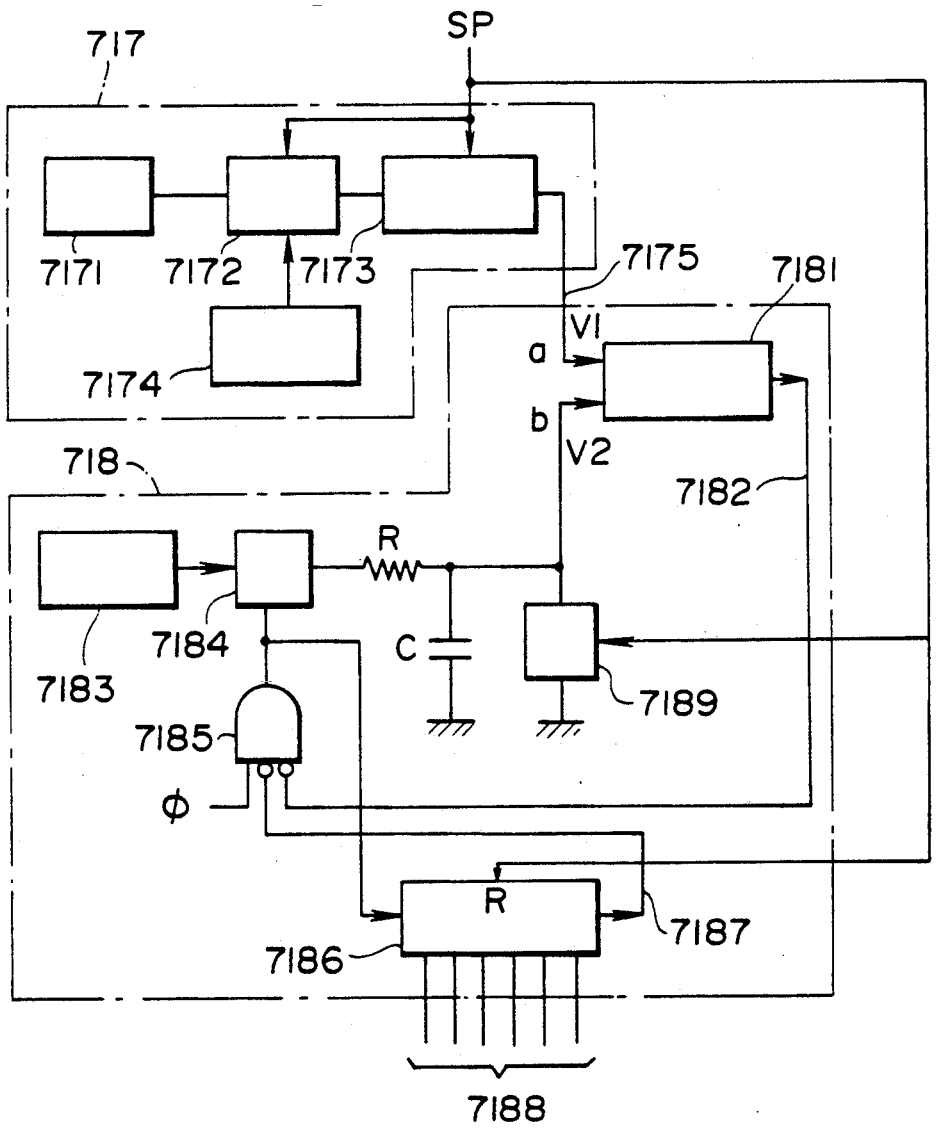
FIG. 8 is a detailed block diagram of the sensor circuit and the A/D converting circuit of a part of FIG. 7.

Next, the insides of the sensor circuit 717 and the A/D converting circuit 718 will be described in detail with reference to FIG. 8. 7171 denotes a temperature measuring sensor such as a thermistor bridge; 7172 denotes an amplifier for a temperature measuring signal (this amplifier may include nonlinear compensation means, if necessary and operates intermittently by sampling signals, and the output voltage rises with the temperature). 7173 denotes a sample holding circuit for keeping the analog output voltage. 7174 denotes a reference voltage source for measuring a temperature with a high degree of accuracy. These elements constitute the sensor circuit 717.

The following is a structure of the A/D converting circuit 718. 7181 denotes a voltage comparing circuit which compares a voltage V1 applied to one terminal "a" with a voltage V2 applied to the other terminal "b", and when V2 is equal to or greater than V1, the circuit outputs a logical level "1" to a line 7182, and when not, it outputs a "0" level. 7183 denotes a fixed voltage power source having a stable and somewhat higher voltage value and charging a capacitance C through a switching TG (transmission gate) 7184 and a resistor R. This charging is intermittently done since the signal $\phi$ which has passed through an AND gate 7185 opens and closes intermittently the TG 7184.

In addition, the number of intermittent charging operations is counted by a base-64 counter 7186. A group of outputs Q each for representing the state of each of binary elements forming the counter 7186 are taken out as A/D converting outputs 7188. Also when the counter 7186 reaches the full count, a "1" level output is produced on a line 7187, and this output acts on a negative input terminal of the AND gate 7185 to block any further passing of the signal $\phi$. The input V1 of the voltage comparing circuit 7181 is an analog temperature output voltage produced on a line 7175 and the input V2 is a charged voltage of the capacitance C. While the latter is lower than the former, the "0" output produced on the line 7182 is applied to the other negative input terminal of the AND gate 7185 and the signal $\phi$ passes through the AND gate 7185, thus keeping the intermittent charging operation.

However, at the moment when the charged voltage of the capacitance C is coincident with or somewhat exceeds the analog output voltage of the temperature, the output of the voltage comparing circuit 7181 is turned to "1" and closes the AND gate 7185 to stop the charging operation and the counting operation of the counter 7186. In this respect, the counter 7186 is reset by the sampling signal SP. A TG 7189 is a transmission gate, which short-circuits the capacitance C and discharges the residual charge, when the sampling signal SP comes. The characteristics of each circuit and the constant of each element are designed so that in the relation between the measured temperature and the count output of the counter 7186, a temperature of $-12°$ C. corresponds to a count of 0 and that $+62°$ C. corresponds to a count of 64. Furthermore, when the temperature is $-12°$ C., the output of the amplifier 7172 is set to just a zero volt.

The important point in this temperature measuring system is that when the temperature is lower than $-12°$ C., then V1 is smaller than 0V and V2 is equal to 0V. Therefore, the output of the voltage comparing circuit 7181 is already at the "1" level and the count value of the counter 7186 remains reset to zero by the sampling signal SP. On the other hand, whenever the temperature is higher than 64° C., V1 is greater than V2, and therefore, the voltage comparing circuit 7181 attempts to permit the charging operation, but the full-count output of the counter 7186 stops the charging operation. Thus, even if the measured temperature exceeds the upper limit or lower limit of the predetermined measuring range, any driving force for forcing the hand outside the predetermined measuring range will not be caused.

That is to say, the following elements correspond to the "inhibiting circuit means"; the amplifier 7172 in which the output at the low temperature end of the measuring range is set to 0 volt; the voltage comparing circuit 7181; the counter 7186 which never produces the A/D converting output exceeding the high temperature end of the measuring range; and the AND gate 7185.

In addition to the two embodiments illustrated above, various alterations and embodiments can be made. For example, the stop may be also used for double purpose, e.g. it is combined with the member making up the dial, against which the hand or part of the gear train abuts in process of motion. In addition, although only the sector-shaped display configuration is illustrated, for example, a linearly guided index (driven by rack and pinion, screw feed mechanism or linkage) may be used. Also, the physical quantity of an object to be measured may be a length, pressure, force, acceleration, speed, radiation dose, luminous energy, electromagnetic quantity, pulse rate, bodily temperature, electrodetmography, frequency, etcetera. It is possible to provide a measuring circuit corresponding to each of them, and various circuit configurations are available for inhibiting the driving output for the hand outside the predetermined measuring range.

Furthermore, of course, a stepping motor having an exciting coil of two-phase, three-phase, etcetera may be used. In this case, the driving waveforms are not always changed, depending on the forward motion and reverse motion. Only by changing the phase of the exciting current to be supplied to each coil, the direction of rotation can be changed. In the event that the hand follows the measured values which lower with time, in the illustrated embodiment, the hand once swings to the maximum value, then, moves all over the range to return to the minimum value, and starting at the minimum value, the hand indicates a new measured value. But without doing this, it is possible, with no special difficulty, to realize a structure that the hand takes the minimum number of steps to follow in either forward or reverse direction against variations of measured values in higher or lower direction.

When using this structure, in the operation for attaching the hand, the hand position counter is reset or set to a specific value and then aiming at the division corresponding to it, the hand may be forcedly fitted. Also, there is wide variation in functional switchover from the time display of the watch. The freedom of the structure according to the invention is very great.

Industrial Applicability

As is apparent from the above explanation, according to the invention, for a display device which is driven by a stepping motor and provides a display in which a hand reciprocates within a predetermined limited region, the hand can be effectively attached in correct relation with the driving mechanism. Therefore, such device can be provided with a small number of assembly processes and for long production run and at low cost. Also, by use of such device, objects to be measured are varified. That is to say, the small display region can be effectively used and the application of the hand display such as a sector-shaped display which is of advantage of viewing is facilitated to increase the range of application and introduce the fresh design into instruments. From these viewpoints, industrial advantages are great.

We claim:

1. A display device by means of a hand comprising:
(a) a stepping motor which rotates in both forward and reverse directions;
(b) a gear train connected to a rotor shaft of said stepping motor;
(c) an indicating member mounting shaft which is one of axes of said gear train and moves by a predetermined quantity per step of said stepping motor in a direction corresponding to a direction of motion of said stepping motor;
(d) an indicating member mounted on said indicating member mounting shaft for displaying information within a sector-shaped region;
(e) an electronic information generating circuit for generating said information;
(f) an electronic information driving signal generating circuit for converting the information generated by said electronic information generating circuit into a driving signal of said stepping motor and producing said signal;
(g) a restriction member for restricting a motion of said gear train so that said indicating member mounting shaft does not move beyond a predetermined movable range;
(h) an electronic initializing driving signal generating circuit for producing predetermined initializing driving signals and for stopping the motion of said stepping motor after producing said driving signals under predetermined control; and
(i) said initializing driving signals comprising driving signals at least equal in number to steps enough to move said indicating member mounting shaft from end to end in one direction within said predetermined movable range thereof.

2. A display device by means of a hand according to claim 1 in which said indicating member is made in a form of a timepiece hand.

3. A display device by means of a hand according to claim 1 in which said indicating member is coupled to said gear train in a predetermined geometric relation in the state after said electronic initializing driving signal generating circuit has produced the driving signals in the enough number of steps under said predetermined control.

4. A display device by means of a hand according to claim 3 in which said indicating member is coupled to said gear train in a predetermined geometric relation in the state after said electronic initializing driving signal generating circuit has produced said second driving signal.

5. A display device by means of a hand according to claim 1 in which said restricting member is a rotary angle restricting member which acts on at least one of the gears in said gear train.

6. A display device by means of a hand according to claim 1 in which the number of steps of the driving signal corresponding to the moving range is larger than the number of steps of the driving signals corresponding to the range in which said indicating member displays said information.

7. A display device by means of a hand according to claim 1 in which said indicating member is coupled to said gear train so as to leave mechanically movable spaces outside both ends of said predetermined range.

8. A display device by means of a hand according to claim 5 in which said restricting member is constituted of a portion of said gear train, and a portion of a fixed member and said portion of said gear train is restricted by the portion of said fixed member.

9. A display device by means of a hand according to claim 4 in which said restricting member is constituted of a portion of said gear train and another portion of said gear train and said portion of said gear train is restricted by said another portion of said gear train.

10. A display device by means of a hand according to claim 1 in which said information is time, a time period or calendar information.

11. A display device by means of a hand according to claim 1 in which after producing driving signals equal in number to steps enough to move the indicating member from end to end in one direction within said movable range, said electronic initializing driving signal generating circuit further produces second driving signals for stepping said stepping motor in the reverse direction by the number of steps less than said enough number of steps.

12. A display device by means of a hand according to claim 1 in which said restricting member is provided substantially at both ends of the moving range of said indicating member.

* * * * *